US005450075A

United States Patent [19]

Waddington

[11] Patent Number: 5,450,075

[45] Date of Patent: Sep. 12, 1995

[54] ROTARY CONTROL

[75] Inventor: George M. Waddington, Hebden Bridge, England

[73] Assignee: AMS Industries PLC, Burnley, England

[21] Appl. No.: 218,848

[22] Filed: Mar. 28, 1994

Related U.S. Application Data

[63] Continuation of Ser. No. 841,283, Feb. 25, 1992, abandoned, which is a continuation-in-part of Ser. No. 268,710, Nov. 8, 1988, abandoned.

[30] Foreign Application Priority Data

Nov. 11, 1987 [GB] United Kingdom ..... 8726365

[51] Int. Cl.[6] ..... G08C 17/00

[52] U.S. Cl. ..... 340/870.28; 341/35

[58] Field of Search ..... 340/825.26, 825.31, 340/825.03, 825.04, 825, 870.28; 345/35; 341/35, 192; 200/308, 316; 116/245, 256, 257, 309, 310; 381/119; 362/32, 23, 26, 37

[56] References Cited

U.S. PATENT DOCUMENTS

| | | | |
|---|---|---|---|
| 2,119,576 | 6/1938 | Goldstine | 116/257 |
| 2,777,637 | 1/1957 | Matthew | 116/245 |
| 3,404,657 | 10/1968 | Zmuda | 116/257 |
| 3,750,619 | 8/1973 | Yamamura | 455/158 |
| 3,836,911 | 9/1974 | Gibson et al. | 340/815.31 |
| 3,846,605 | 11/1974 | Pirchl | 200/316 |
| 3,857,361 | 12/1974 | Gibson et al. | 455/158 |
| 3,889,196 | 6/1975 | Gibson et al. | 340/825.31 |
| 3,906,345 | 9/1975 | Bertolasi | 340/815.03 |
| 3,916,317 | 10/1975 | Gibson et al. | 116/257 |
| 3,918,392 | 11/1975 | Gibson et al. | 455/158 |
| 4,044,242 | 8/1977 | Laesser | 341/35 |
| 4,188,654 | 2/1980 | Reich et al. | 362/32 |
| 4,568,927 | 2/1986 | Fowler | 340/753 |

FOREIGN PATENT DOCUMENTS

| | | | |
|---|---|---|---|
| 86486 | 5/1983 | Japan | 340/815.04 |

*Primary Examiner*—Donald J. Yusko
*Assistant Examiner*—Edwin C. Holloway, III
*Attorney, Agent, or Firm*—Salter & Michaelson

[57] ABSTRACT

A rotary control for a music mixing desk consists of a cylindrical knob which includes an information display. The knob is fashioned from an electrically conductive plastic material and is in electrical contact with the spindle of the knob which is connected to a touch sensitive circuit. The rotary control is thereby able to sense the touch of a mixing desk operator without the operator having to turn the knob. The mixing desk can be programmed to undertake various actions upon touching the knob. The display consists of a plurality of light transmitting channels composed of an optic fiber or a wave guide comprising a bundle of optic fibers. Light transmitting elements are disposed at one end of respective channels and circuitry connected to the elements enable certain selected elements to be activated to denote certain conditions. In this way display of signal conditions can be made within a restricted space. The display may also consists of a matrix of light emitting diodes or liquid crystal displays which are provided on top of the knob.

8 Claims, 5 Drawing Sheets

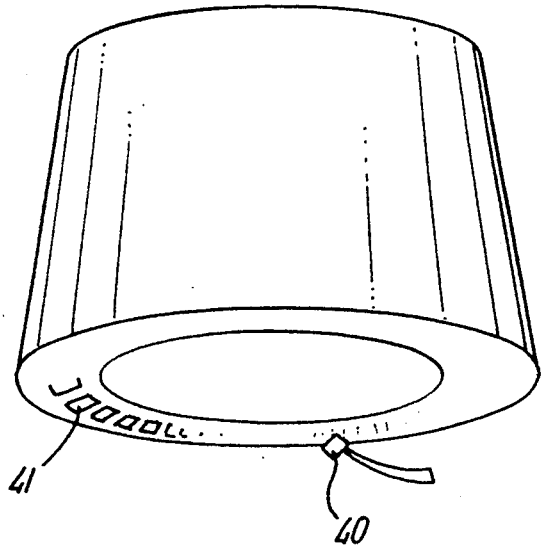
FIG. 8
FIG. 9
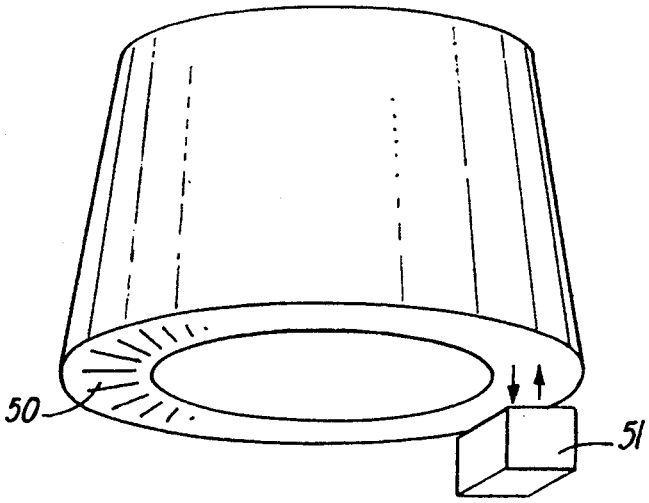

ROTARY CONTROL

This is a continuation of application Ser. No. 07/841,283 filed Feb. 25, 1992, now abandoned, which is a continuation in part of application Ser. No. 07/268,710 filed Nov. 8, 1988, now abandoned.

The present invention relates to a rotary control.

The control is particularly, but not exclusively intended for music mixing desks where in excess of a thousand rotary controls may be accommodated in a relatively small area. In a known desk, bar graphs, either horizontally or vertically arranged, are associated with rotary controls to display information in dependence upon the position of the controls. These bar graphs display the information quite satisfactorily but their horizontal or vertical extent imposes limitations on the density of controls which may be incorporated in the desk and therefore, for a given capacity increases the size of the desk. As these desks are usually controlled by a single person this is an important consideration.

According to the present invention there is provided a rotary control comprising a body formed to receive a substantially centrally located spindle, means formed within the body for displaying information relating to a parameter controlled by the knob, and means for detecting the touch of an operator on the rotary control.

In a preferred embodiment of the invention, the rotary control comprises a substantially cylindrical body of synthetic plastics material through which a plurality of axially extending holes have been formed close to the periphery of the body. Each of these holes accommodates an optic fiber for the transmission of light. The body also defines a central axially extending bore to accommodate a spindle. At the lower end of each fiber, a light emitting element such as a light emitting diode or a liquid crystal display is disposed. The signals from these light emitting elements are transmitted by the optic fibers. By arranging the signals appropriately a variety of operative conditions can be represented.

In order that the invention may be more clearly understood, embodiments thereof will now be described by way of example with reference to the accompanying drawing, in which:

FIG. 8 is a perspective view from the underside of a modification of the embodiment of FIG. 5, FIG. 9 is a perspective view from the underside of another modification of the embodiment of FIG. 5.

Figure 1:
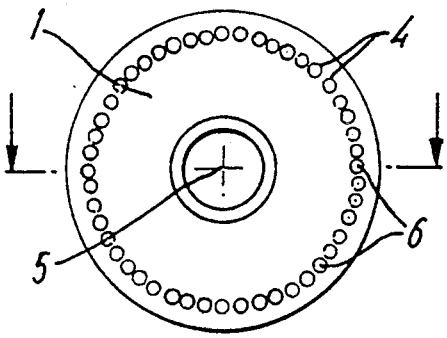
FIG. 1 is a plan view of one form of rotary control according to the invention.
Figure 2:
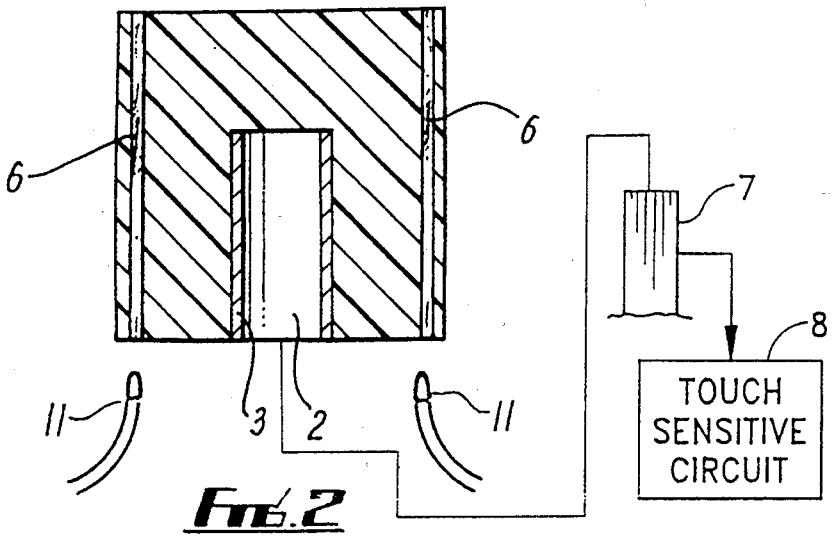
FIG. 2 is a side elevation in section of the control of FIG. 1.

Referring to FIGS. 1 and 2, the rotary control comprises a cylinder 1 of rigid synthetic, electrically conductive plastics material. This cylinder is formed, for example by drilling or casting, with a blind recess 2 extending axially from its underside and into which a collet 3 made of an electrically conductive material, such as brass is inserted. In use, the collet is mounted with a press fit on a spindle 7 to mount the control. The spindle 7 is also preferably formed from an electrically conductive material and it is connected to a touch sensitive circuit 8. In this regard, the cylinder 1, the collet 3, and the spindle 7 form an electrically conductive, low resistance pathway between the surface of the cylinder 1 and a touch sensitive circuit 8 to provide the rotary control with touch sensitive characteristics. The knob may be mounted in a variety of other ways. For example, by splines, a D shaped shaft or screw. In the case of a screw the knob has a plane bore and the screw extends down the center of the encoder shaft. It is pointed out that in any mounting arrangement of the knob on the spindle, it is important that an electrical pathway be defined between the outer surface of the knob and a touch sensitive circuit in order to provide the touch sensitive characteristics.

The control is operative with a conventional touch sensitive circuit 8 for detecting the touch of an operator of the control. Touch sensitive circuits are well known in the art and they are typically operative for detecting the presence of the operator by detecting capacitive or resistive loading in an electrical pathway. In the instant invention, when an operator of the rotary control touches the cylinder 1, a touch sensitive circuit detects capacitive or resistive loading in the electrical pathway caused by the operator's contact with the cylinder. This touch sensitive feature is particularly advantageous for use in music mixing desks where the rotary controls enable electrical signals to be manipulated to provide desired end musical effects. These manipulations are often computer controlled. However, it is common for an operator to intercede in the computer controlled operation, for example, to increase or decrease the amplitude of the musical characteristic being processed. In the prior art music mixing desks, it has been necessary to generate an override signal to interrupt a computer controlled process before an operator rotates the appropriate control. It has been found that the existence of an override signal can cause unwanted changes in one or more of the parameters of the signal being processed. By providing touch sensitive characteristics to the rotary controls of a mixing desk, the mixing desk can be programmed to halt computer controlled operations when an operator touches one of the controls. With the computer controlled processes halted, the operator can then impose the desired changes after which the mixing desk can be returned to its' computer controlled operation.

Figure 3:
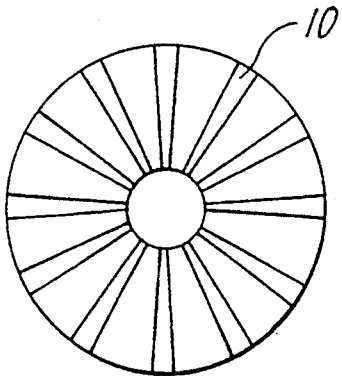
FIG. 3 is a plan view of an alternative to the control of FIGS. 1 and 2.

The cylinder 1 is also formed again, for example, by drilling or casting, with a plurality of channels 4. These channels are coaxial with the central axis 5 of the control and are disposed close to the periphery of the control in a ring around this central axis. They extend from the underside to the top surface of the control and each accommodates a fiber optic 6. The channels may be of closed cross section, as shown in FIGS. 1 and 2, or may be of open cross-section in which case they may be formed by segments 10 cut from the cylindrical surface of the cylinder 1. Such an arrangement is shown in FIG. 3.

The number of channels or segments incorporated will be governed by the diameter of the rotary control and the size of the fiber optics. In one example, however, the control has a diameter of 15 mm and houses fiber optics each 2 mm in diameter.

In use a light emitting element 11 is disposed on the underside of each fiber optic 6. The element may be a light emitting diode or a back lit liquid crystal display. Each fiber optic carries the light from its respective light emitting element 11 from the underside of the control to its upper surface to display the light at that surface. Electronic circuitry is disposed between the spindle and the light emitting element so that a variety of operative states can be displayed by the fiber optics. For example, where the control position simply represents the volume of a particular sound source, that volume can be represented by the progressive illumination of diodes from a zero reference point so that a curved illuminated line of increasing or decreasing length is produced as the control is turned to increase or decrease the volume. Alternatively, the volume may simply be indicated by the illumination of a single appropriately positioned diode, this diode changing as the volume is increased or decreased. Specific permutations of illuminated diodes may be selected to represent specific operational conditions. For example, a castellated display, where every other diode is illuminated progressively can be used to indicate stereo gain for example.

Figure 5:
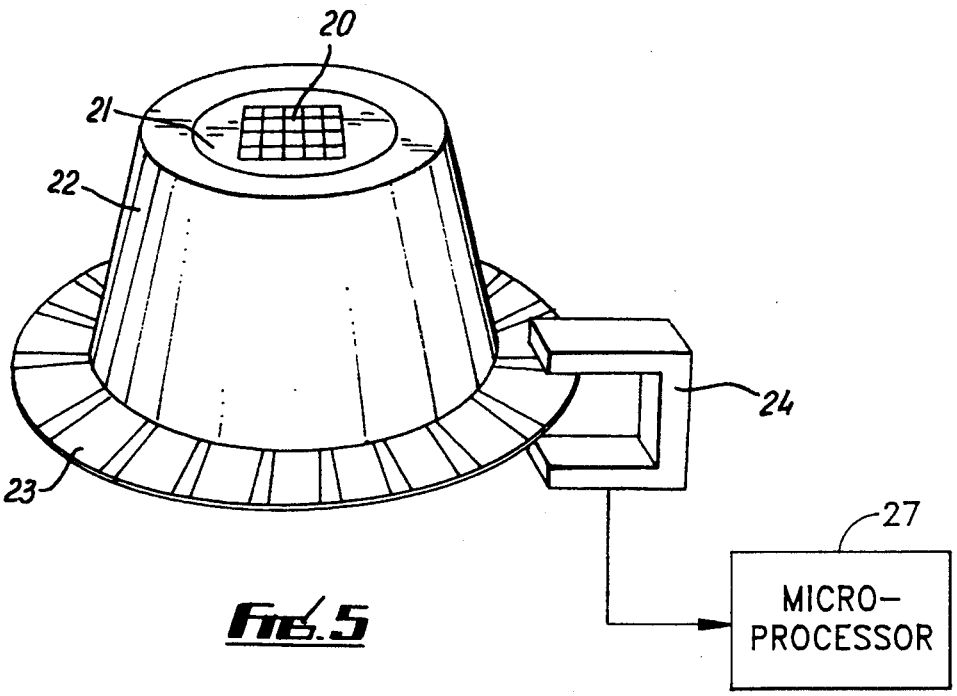
FIG. 5 is a perspective view of another alternative rotary control to that of FIG. 1 and FIG. 2.
Figure 6:
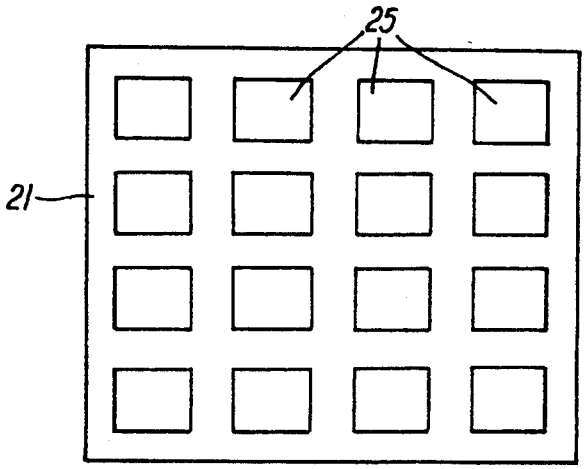
FIG. 6 is an enlarged view of a part of the control FIG. 5.

FIG. 5 shows a further embodiment of the invention. In this arrangement the rotary control has a matrix 20 set into the top of the control. This may be square or circular tailored to the shape of the knob. A display controller is associated with the display. The matrix may comprise a plurality of light emitting diodes or liquid crystal display elements or pixels. These elements/pixels may be polygonal, for example, hexagonal, as the image/knob may stop in any position. In one form the diodes or elements have an area of 0.3 $mm^2$ and are spaced about 0.05 mm apart. An arrangement having sixteen such diodes or elements 25 arranged in a four square display is shown in FIG. 6. The knob itself has concentrically arranged inner and outer parts 21 and 22. The inner part is static and supports the matrix and the outer part is mounted for relative rotational movement about the inner part. The outer part supports a circumferential graticule 23 at its base. A sensor reader 24 is disposed adjacent the graticule. These two parts comprise a rotary shaft encoder. Information relating to the parameter being controlled is transferred via this contractless sensor graticule arrangement and is displayed by the elements of the matrix 20.

Figure 7:
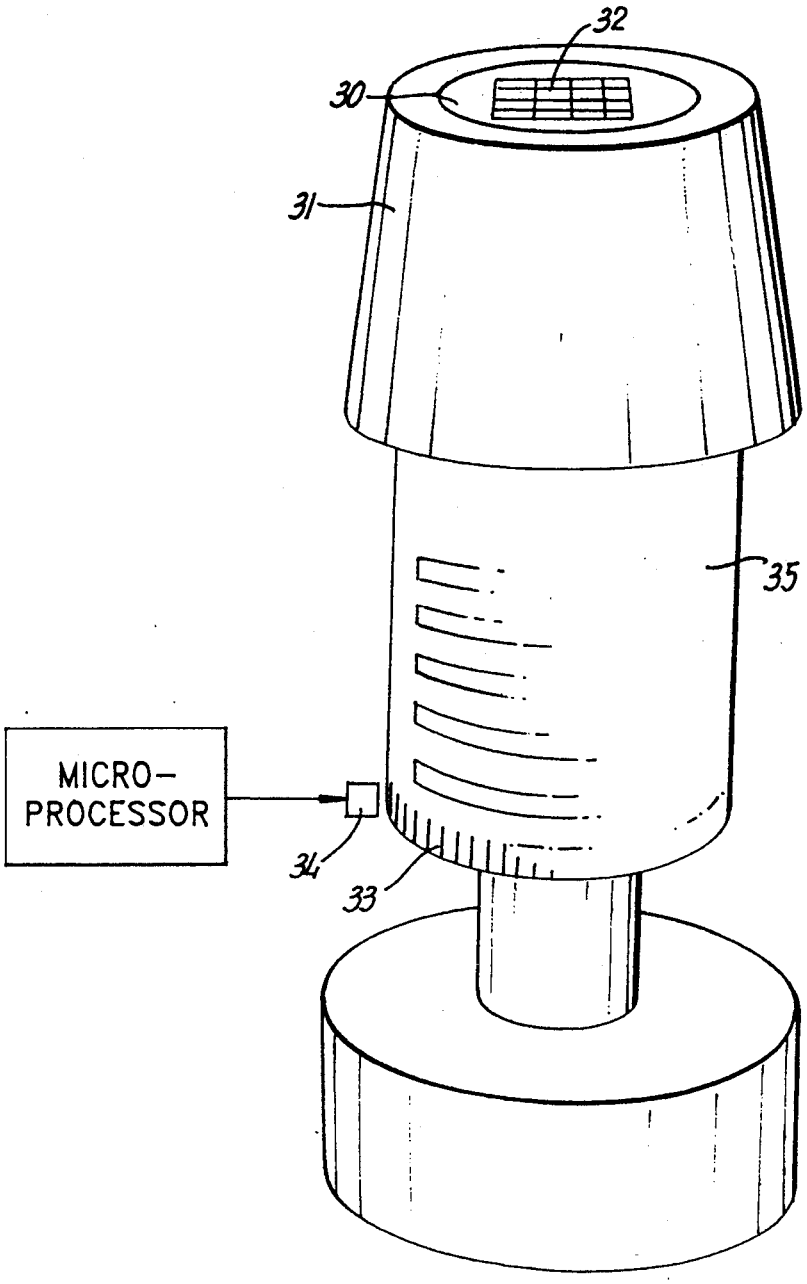
FIG. 7 is a modified rotary control similar to that FIG. 5.

FIG. 7 shows an alternative embodiment to the embodiment of FIG. 5. The control of this figure also has inner and outer relatively rotational parts 30 and 31. The inner part is static and supports a matrix 32 as in the FIG. 5 embodiment. The outer part rotates around the inner part and has a downwardly dependent extension 35. This extension 35 supports a plurality of horizontally disposed parallel arranged slip rings of conductive material. The graticule and reader (referenced 33) and the electronics for controlling the display, which may, for example, be in the form of a dot matrix or ring is incorporated in the knob. The whole assembly, including the display, rotates. To maintain a static image, data is fed to the display controller to rotate the image in the opposite direction to but at the same rate as that of the knob being adjusted. The slip rings supply the power and data connections for the controller. The pixels of the display can be polygonal, for example, hexagonal in order to improve resolution as the image or knob may stop in any position. As with the embodiment of FIG. 5 a rotary shaft encoder comprising a graticule 33 and reader 34 is provided. In both embodiments, the positional data of the encoder is read by a microprocessor 27 which then transmits instruction to the display controller as appropriate.

FIGS. 8 and 9 respectively show alternative information transfer arrangements to the graticule and slip rings of the embodiments of FIGS. 5 and 7. In the arrangement of FIG. 8, an electrically conductive contact 40 cooperates with spaced carbon segments 41 disposed around the underside of the outer rotational part of the two part control. In the arrangement of FIG. 9, the carbon segments are effectively replaced by either spaced non-reflective or spaced reflective areas 50. A sensor 51 cooperates with the areas 50 to provide a contactless information transmission arrangement.

Figure 10:
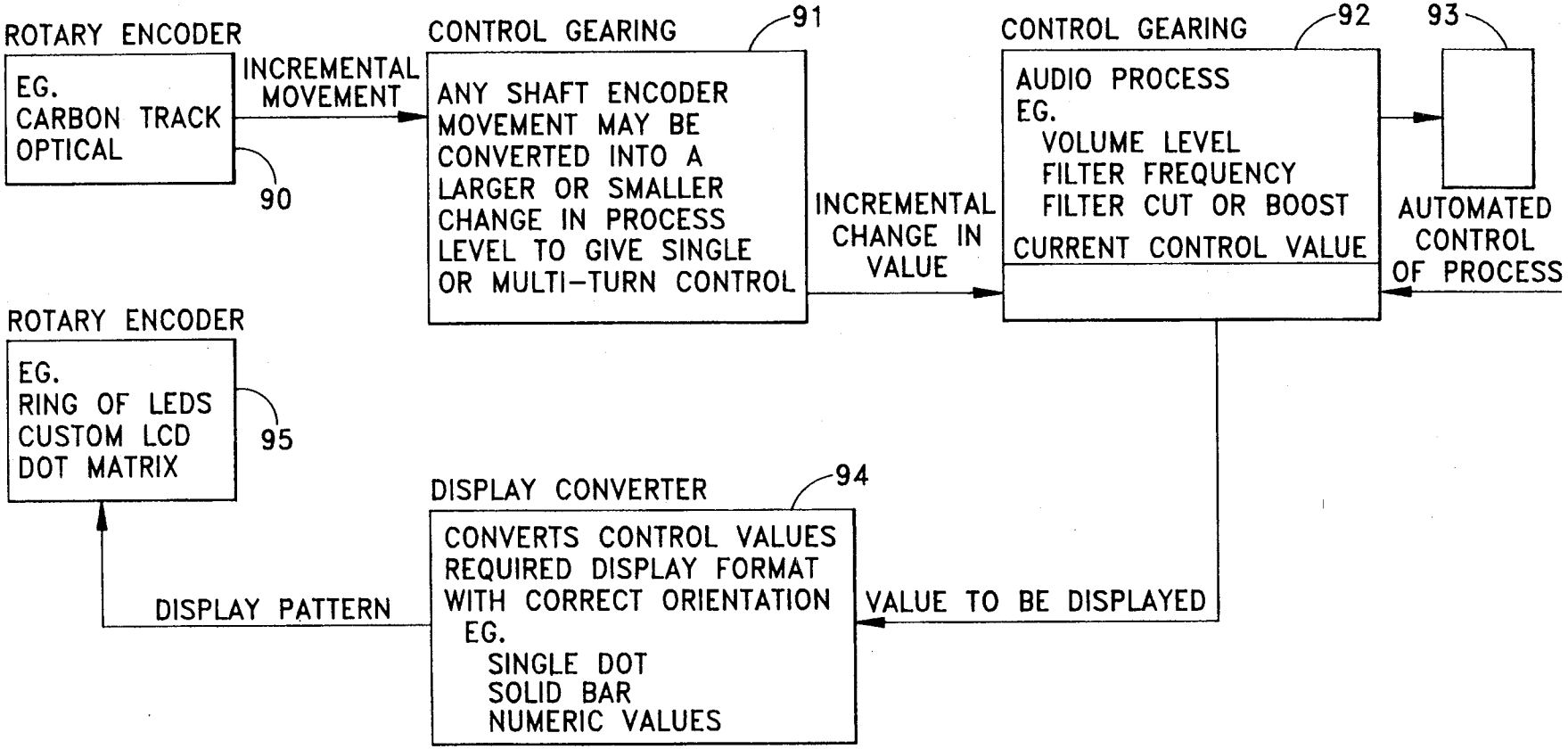
FIG. 10 is a block diagram showing the operational functions of the rotary control.

FIG. 10 is a block diagram showing the operational functions of the rotary control just described. Rotating the control correspondingly alters the position of the rotary encoder 90. This movement is fed to control gearing 91 which may convert it into a larger or smaller change in process level to give single or multi-turn control. The resultant change in value is applied to the selected parameters of the process under control 92. In an audio process these may be volume level filter frequency, filter cut or boost. The continuation variation of these process parameters may be stored at 93 and this stored information used subsequently for automatic process control.

The process control electronics 92 produce a value to be displayed relating to the selected process parameters. This is fed to the display controller 94 which converts the control value into the required display format with correct orientation. This may for example be a single dot, solid bar or numeric value. The controller 94 outputs a signal representing the required display to the display 95 which may comprise a ring of LED's a custom made LCD or a dot matrix.

Figure 4:
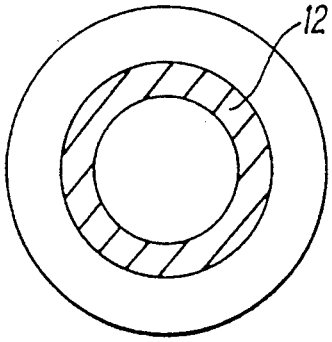
FIG. 4 is a plan view of another alternative to the control of FIGS. 1 and 2.

It will be appreciated that the above embodiments have been described by way of example only and that many variations are possible without departing from the invention. For example, referring to FIG. 4, the fibre optics may be replaced by a light guide in which each channel may be replaced by a bundle of fiber optics (see magnified partial view in FIG. 4) forming a ring 1 in which alpha-numeric characters can be transmitted thus greatly increasing the versatility of the control for transmitting operational information. Different color may also be used to indicate different information.

I claim:

1. A rotary control comprising:

a base having a rotatable spindle mounted thereon;

a body of rotationally symmetrical configuration including an axially extending bore for receiving said spindle, said body being coaxially rotatable with said spindle, said body including an end face and a lower face and further including a plurality of individual channels which extend through said body from said lower face to said end face;

a sensor for sensing an angular position of said body;

a plurality of light emitting elements mounted in said base around the axis of said spindle beneath said lower face wherein light emitted from said light emitting elements is visible through said channels; and a control for controlling the operation of said light emitting elements in response to said angular position of said body.

2. The rotary control of claim 1 further comprising a sensor for detecting the touch of an operator of said rotary control.

3. The rotary control of claim 2 wherein said body and said spindle are fabricated from an electrically conductive material, said body being in electrical contact with said spindle, said spindle being electrically connected to a touch sensitive circuit, said body and said spindle forming an electrical pathway between an operator of said rotary control and said touch sensitive circuit, said circuit being operable for detecting the touch of an operator to said body.

4. The rotary control of claim 3 further comprising a plurality of light transmitting elements received in said channels.

5. In the rotary control of claim 4, said light transmitting elements comprising optical fibers.

6. A rotary control comprising:

a base having a rotatable spindle mounted thereon;

a body of rotationally symmetrical configuration including an axially extending bore for receiving said spindle, said body being coaxially rotatable with said spindle, said body including an end face and a lower face and further including a plurality of individual channels disposed around the axis of rotation of said spindle at a predetermined radius to said axis of rotation, said channels extending through said body from said lower face to said end face;

a sensor for sensing an angular position of said body;

a plurality of light emitting elements mounted in said base around the axis of said spindle at said predetermined radius so that light emitted from said light emitting elements is transmitted through said channels; and a control for controlling the operation of said light emitting elements in response to said angular position of said body.

7. The rotary control of claim 6 further comprising a sensor for detecting the touch of an operator of said rotary control.

8. The rotary control of claim 7 wherein said body and said spindle are fabricated from an electrically conductive material, said body being in electrical contact with said spindle, said spindle being electrically connected to a touch sensitive circuit, said body and said spindle forming an electrical pathway between an operator of said rotary control and said touch sensitive circuit, said circuit being operable for detecting the touch of an operator to said body.

* * * * *